US006259019B1

(12) United States Patent
Damilo et al.

(10) Patent No.: US 6,259,019 B1
(45) Date of Patent: Jul. 10, 2001

(54) CABLE FOR TRANSMITTING DATA AND METHOD OF MANUFACTURING IT

(75) Inventors: Serge Damilo, Charleville-Meziere; Daniel Prudhon, Fumay, both of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/049,143

(22) Filed: Mar. 27, 1998

(30) Foreign Application Priority Data

Mar. 27, 1997 (FR) ..... 97 03751

(51) Int. Cl.[7] ..... H01B 11/06
(52) U.S. Cl. ..... 174/36; 174/102 R; 174/105 R
(58) Field of Search ..... 174/36, 35 R, 174/102 R, 105 R, 113 R, 120 R, 109

(56) References Cited

U.S. PATENT DOCUMENTS

| | | | | |
|---|---|---|---|---|
| 3,321,572 | | 5/1967 | Garner et al. | 174/105 |
| 4,510,346 | * | 4/1985 | Bursh et al. | 174/36 |
| 5,132,491 | * | 7/1992 | Mulrooney et al. | 174/36 |
| 5,144,098 | * | 9/1992 | Van Deusen | 174/36 |
| 5,208,426 | * | 5/1993 | Kennedy et al. | 174/36 |
| 5,216,202 | * | 6/1993 | Yoshida et al. | 174/36 |
| 5,541,361 | * | 7/1996 | Friesen et al. | 174/34 |

FOREIGN PATENT DOCUMENTS

0759624A1 2/1997 (EP) .

* cited by examiner

*Primary Examiner*—Dean A. Reichard
*Assistant Examiner*—William H Mayo, III
(74) *Attorney, Agent, or Firm*—Sughrue, Mion, Zinn, Macpeak & Seas, PLLC

(57) ABSTRACT

A cable includes at least one electrical conductor surrounded by a shield protecting against high-frequency electromagnetic interference. The shield includes an inner tape disposed lengthwise having a conductive layer and an outer tape disposed lengthwise having a conductive layer covered by an insulative layer. The conductive layer of the outer tape facing inwards so that the respective conductive layers of the inner and outer tapes are in contact. At least one of the two tapes has overlapping longitudinal edges. The insulative material of the insulative layer of the outer tape is adhesively bonded to the inside wall of a jacket. The protection is effective up to at least 500 MHz.

14 Claims, 1 Drawing Sheet

CABLE FOR TRANSMITTING DATA AND METHOD OF MANUFACTURING IT

BACKGROUND OF THE INVENTION

1. Field of the Invention

The present invention concerns a cable for transmitting data comprising a conductive shield for protecting one or more conductors against external electromagnetic interference.

2. Description of the Prior Art

Data is usually transmitted by means of insulated electrical conductors surrounded by one or more metallic shields, the shield or shields being enclosed within a jacket.

The shield isolates the conductors from external electromagnetic interference. The best protection is obtained when the conductive shield is continuous, without openings in it. However, the usual manufacturing techniques impose the use of one or more tapes to form the shield which necessarily leads to openings in the latter which limit the efficacy of the shield at the highest frequencies.

The best shields provide effective protection up to frequencies in the order of 30 MHz to 40 MHz. Until now the best results have been obtained with a metal tape disposed lengthwise with the longitudinal edges overlapping. A lengthwise tape gives better results than a helically wound tape because the opening extends a shorter distance.

Increasing data bit rates in cables are leading to an increase in the limiting frequency below which cables are protected from the external environment.

U.S. Pat. No. 4,510,346 proposes a cable including at least one electrical conductor surrounded by a shield to protect against high-frequency electromagnetic interference. The shield includes an inner tape disposed lengthwise and an outer tape disposed lengthwise, each tape having a conductive layer covered by an insulative layer. The conductive layer of the inner tape faces outwards and the conductive layer of the outer tape faces inwards so that the conductive layers are pressed together. At least one of the two tapes has overlapping longitudinal edges.

Although the shield of a cable of the above kind provides effective protection against electromagnetic interference up to very high frequencies (at least 100 MHz), it nevertheless gives rise to a major problem, namely that of ease of stripping. The outer tape, disposed lengthwise, with its conductive layer on the inside against the conductive layer of the inner tape prevents easy access to the conductive part of the shield and therefore makes it difficult to connect the cable.

An aim of the present invention is to solve this problem by proposing a cable that is effective at very high frequencies, typically above 100 MHz, and easier to strip than prior art cables effective at such frequencies.

SUMMARY OF THE INVENTION

To this end the present invention proposes a cable including at least one electrical conductor surrounded by a shield protecting against high-frequency electromagnetic interference, said shield including an inner tape disposed lengthwise having a conductive layer and an outer tape disposed lengthwise having a conductive layer covered by an insulative layer, said conductive layer of said outer tape facing inwards so that the respective conductive layers of said inner and outer tapes are in contact, and at least one of the two tapes having overlapping longitudinal edge regions, wherein said insulative material of said insulative layer of said outer tape is adhesively bonded to the inside wall of a jacket.

The cable of the invention is protected against interference at frequencies up to 1 GHz. The cable of the invention is particularly simple to connect because, on opening the jacket, the outer tape remains stuck to the latter and only the conductive layer of the inner tape remains visible. Connecting the cable of the invention to a connector is therefore facilitated.

The area of the longitudinal edges of the inner tape is advantageously covered by a continuous area of the outer tape. This assures good electrical continuity of the shield. In this case, the areas of the longitudinal edges of the tapes are preferably opposite each other.

The inner tape preferably further comprises a conductive layer covered with an insulative layer, for example a polyester layer. In this way the inner and outer tapes can slide correctly on guides during manufacture. This minimizes the risk of damage by rubbing.

The outer tape can be adhesively bonded to the jacket. To this end, in one embodiment, the material of the jacket is extruded at a sufficiently high temperature for the plastics material of the outer tape to soften and bond to the inside surface of the jacket.

An electrical continuity wire can be disposed between the two shields. This improves the contact between the electrical continuity wire and the metal of one of the two tapes, preferably the metal of the inner tape. Improved protection against interference at low frequencies has also been observed.

To manufacture the cable in accordance with the invention the jacket can be extruded at a temperature such that it bonds to the insulative layer of the outer tape.

The inner and outer tapes can be preformed in the same guide. In this way the two tapes do not move relative to each other which prevents potentially harmful rubbing between the conductive layer of the inner tape and the conductive layer of the outer tape.

Other features and advantages of the invention will become apparent from the following description of embodiments of the invention given with reference to the appended drawing.

DETAILED DESCRIPTION OF THE PREFERRED EMBODIMENT

Figure 1:
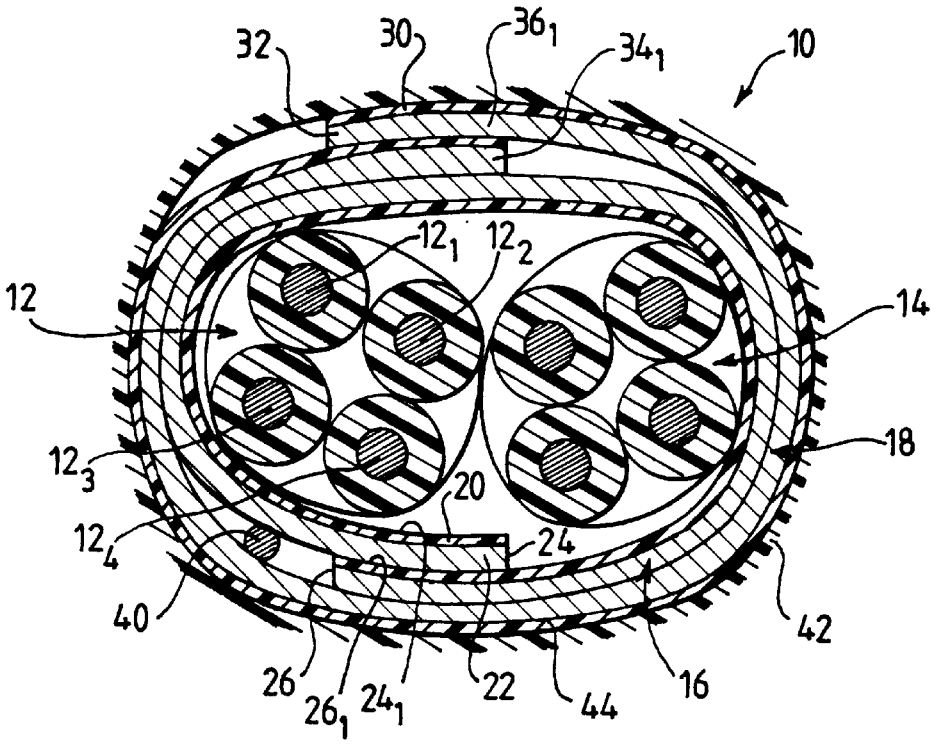
FIG. 1 is a diagrammatic view in section of a cable in accordance with the invention.

The cable 10 shown in FIG. 1 is designed to carry data at high bit rates, in particular in data processing applications.

In this example the cable includes two quads 12 and 14, each quad being formed by a set of four insulated conductors, for example the conductors $\mathbf{12}_1$, $\mathbf{12}_2$, $\mathbf{12}_3$ and $\mathbf{12}_4$ in the case of the quad 12.

In accordance with the invention, a shield is provided to protect the conductors against external interference and is in the form of two tapes, one tape 18 surrounding the other tape 16.

Each tape has two layers, namely a 25 $\mu$m thick aluminum layer and a 12 $\mu$m thick polyester layer.

The polyester layer 20 of the inner tape 16 faces inwards, i.e. towards the quads 12 and 14, and the conductive layer 22 of the inner tape 16 faces outwards.

The inner tape 16 is disposed lengthwise, i.e. its longitudinal edges 24 and 26 run along the length of the cable and the longitudinal edge regions $24_1$ and $26_1$ of the tape, which terminate in said longitudinal edges 24 and 26, overlap and remain on one side of the cable.

The outer tape 18, which has exactly the same construction and dimensions as the inner tape 16, is disposed around the inner tape 16. However, its polyester layer 30 faces outwards and its conductive layer 32 therefore faces inwards. Like the inner tape 16, the outer tape 18 is disposed lengthwise with longitudinal edge regions $34_1$ and $36_1$ overlapping opposite the overlapping edge regions $24_1$ and $26_1$ of the inner tape 16.

A continuity wire or conductor 40 is disposed between the inner and outer tapes.

Finally, the entire assembly is covered by a jacket 42.

In accordance with the invention the outwardly facing polyester layer 30 of the outer tape 18 is adhesively bonded to the inside face of the jacket 42. This bonding is effected during extrusion of the jacket. The extrusion is carried out at a temperature sufficiently high for the polyester 30 of the outer tape 18 to soften and therefore bond to the jacket 42.

To connect the cable to a connector the jacket 42 is removed at the corresponding end. This exposes the inner tape 16. Its conductive layer 22, facing outwards, enables easy connection.

To manufacture the cable the two tapes 16 and 18 are preformed by the same guides (not shown).

During manufacture, before bonding, the polyester faces of the tapes are in contact with the guides. This minimizes the risk of damage by rubbing.

Contact of the conductive layer 32 of the outer tape with the conductive layer 22 of the inner tape minimizes the risk of gaps appearing that are vulnerable to external electromagnetic interference. The opposite positions of the overlapping edges are also particularly favorable to minimizing interference. For this reason it is preferable for the area of the overlapping longitudinal edge regions $24_1$ and $26_1$ of the inner tape 16 to be covered by a continuous area 44 of the outer tape.

Figure 2:
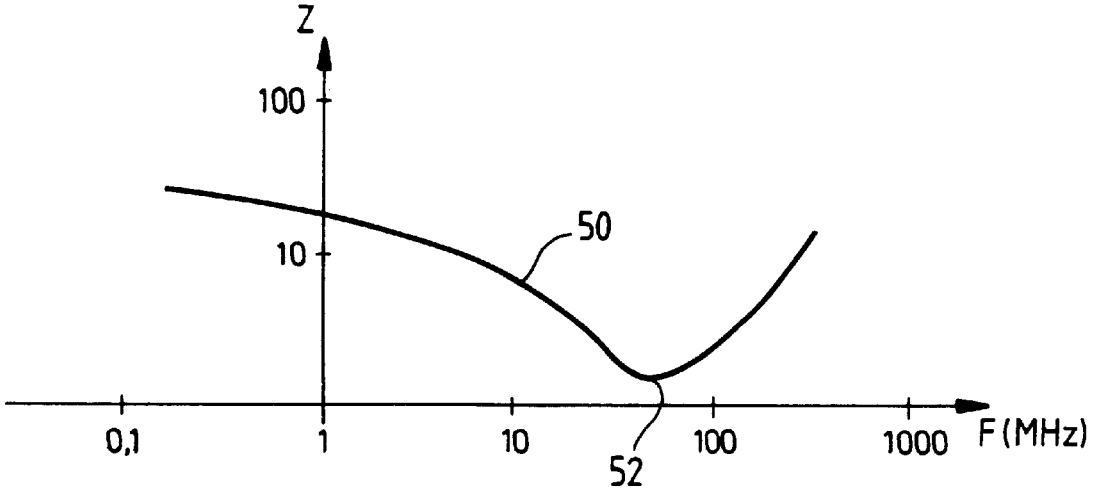
FIG. 2 is a diagram showing the effect of the invention.

FIG. 2 is a diagram in which the frequency F in MHz is plotted on the abscissa axis and the transfer impedance Z of the cable is plotted on the ordinate axis. The lower the impedance Z the better the performance of the cable. Note that the impedance Z represented by the curve 50 has a minimum 52 at around 80 MHz and that its value is satisfactory throughout the measurement range, i.e. up to around 500 MHz.

There is claimed:

1. A cable including at least one electrical conductor surrounded by a shield protecting against high-frequency electromagnetic interference, said shield including an inner tape disposed lengthwise and having a conductive layer and an outer tape disposed lengthwise, and having a conductive layer covered by an insulative layer, said conductive layer of said outer tape facing inwards so that said conductive layers of said inner and outer tapes are in contact with each other, and at least one of said inner and outer tapes have overlapping longitudinal edge regions, wherein insulative layer of said outer tape is adhesively bonded to an inside wall of a jacket, wherein said inner tape comprises a non-adhesive insulative layer facing said at least one electrical conductor.

2. The cable claimed in claim 1 wherein both of said inner and outer tapes have overlapping longitudinal edge regions and wherein an area of said longitudinal edge regions of said inner tape is covered by a continuous area of said outer tape.

3. The cable claimed in claim 2 wherein said area of said longitudinal edge regions of said inner tape is opposite an area of said longitudinal edge regions of said outer tape.

4. The cable claimed in claim 1 wherein said conductive layers of said inner and outer tapes are based on aluminum.

5. The cable claimed in claim 1 wherein said inner tape includes an insulative layer, for example a polyester layer, covering said conductive layer.

6. The cable claimed in claim 1 wherein said insulative layer of said outer tape is a polyester layer.

7. The cable claimed in claim 1 wherein said inner tape and said outer tape has substantially identical constructions and dimensions.

8. A cable as claimed in claim 1 including a continuity conductive wire disposed between said inner and outer tapes.

9. A method of manufacturing a cable as claimed in claim 1 wherein said jacket is extruded at a temperature such that it bonds to said insulative layer of said outer tape.

10. A method of manufacturing a cable as claimed in claim 1 wherein said inner and outer tapes are preformed in a same guide.

11. The cable claimed in claim 1, wherein said outer tape consists of an inwardly facing conductive layer and an outwardly facing insulative layer.

12. The cable claimed in claim 1, wherein said insulative layer is of a material which softens at an extrusion temperature of said jacket to thereby bond said outer tape to said jacket.

13. The cable claimed in claim 1, wherein said insulative layers of said inner and outer tapes are the same material.

14. A cable including at least one electrical conductor surrounded by a shield protecting against high-frequency electromagnetic interference, said shield including an inner tape disposed lengthwise and having a conductive layer and an outer tape disposed lengthwise, and having a conductive layer covered by an insulative layer, said conductive layer of said outer tape facing inwards so that said conductive layers of said inner and outer tapes are in contact with each other, and at least one of said inner and outer tapes have overlapping longitudinal edge regions, where said insulative layer of said outer tape is adhesively bonded to an inside wall of a jacket, wherein said inner tape consists of an outwardly facing metal layer and an inwardly facing non-adhesive insulative layer.

* * * * *